United States Patent [19]

Angelone

[11] Patent Number: 4,955,494

[45] Date of Patent: Sep. 11, 1990

[54] FUEL CONTAINMENT MODULE

[76] Inventor: James D. Angelone, 5222 NW. 92 La., Coral Springs, Fla. 33067

[21] Appl. No.: 375,906

[22] Filed: Jul. 6, 1989

[51] Int. Cl.[5] ..... B65D 88/74

[52] U.S. Cl. ..... 220/587; 137/587; 220/18; 220/85 S; 220/88 R; 220/469

[58] Field of Search ..... 137/357, 358, 363, 571, 137/587; 220/1 B, 5 A, 18, 85 R, 85 S, 88 R, 445, 469

[56] References Cited

U.S. PATENT DOCUMENTS

| | | | |
|---|---|---|---|
| 189,326 | 4/1877 | Sherriff . | |
| 705,925 | 7/1902 | Hazeldine | 220/88 R |
| 1,007,828 | 11/1911 | Webb | 220/88 R |
| 1,371,427 | 3/1921 | Kerr . | |
| 2,538,492 | 1/1951 | Anderson et al. | 169/66 |
| 2,558,694 | 5/1957 | Speig | 220/88 R |
| 2,944,563 | 7/1960 | Blasio et al. | 220/445 |
| 3,848,765 | 11/1974 | Durkop | 220/18 |
| 4,041,722 | 8/1977 | Terlesky et al. | 220/445 |
| 4,390,040 | 6/1983 | Beyen . | |
| 4,469,129 | 9/1984 | Dixon | 137/587 |
| 4,638,920 | 1/1987 | Goodhues, Jr. . | |
| 4,685,327 | 8/1987 | Sharp . | |
| 4,697,618 | 10/1987 | Youtt et al. | 220/1 B |
| 4,715,513 | 12/1987 | Shelton, Jr. | 220/5 A |

FOREIGN PATENT DOCUMENTS

| | | | |
|---|---|---|---|
| 0459624 | 9/1936 | United Kingdom | 220/85 S |

*Primary Examiner*—Jimmy G. Foster

[57] ABSTRACT

An above-ground storage device for volatile liquid, the device comprising a tank for storing volatile liquid, a base disposed on the ground beneath the tank, an enclosure including walls mounted on and above the base for encasing the tank, the enclosure defining air space between the tank and the walls, an air space ventilation device for ventilating the air space, a tank vent including at least one duct extending from the tank through one of the walls for ventilating the tank, and fire retaining material disposed on the walls for retaining a tank fire within the enclosure.

18 Claims, 4 Drawing Sheets

FUEL CONTAINMENT MODULE

BACKGROUND OF THE INVENTION

1. Field of the Invention

The present invention relates to a containment structure for volatile liquids and more specifically to an above-ground fuel containment module.

2. Description of the Related Art

Various types of structures have been constructed for storing large quantities of volatile liquids such as petroleum products. One common structure includes a fuel tank disposed beneath the ground. There are numerous drawbacks with below ground tanks. First, the tanks are costly to install and require a relatively long installation period. Second, tank leaks are difficult to detect and costly to repair. Underground tank leaks also cause environmental problems such as ground water contamination. While an above-ground tank is easier to install and repair, fire regulations in many municipalities require that fuel tanks be located outdoors. This requirement exposes the tank to damage by the elements and makes the tank more susceptible to tampering. In addition, a leak in an above-ground tank cannot only cause environmental hazards, but also fire hazards as well.

It is an object of the present invention to provide an above-ground fuel storage device that is inexpensive to install and repair. It is also an object of the present invention to provide a fuel storage device that is environmentally safe. Another object of the present invention is to provide an above-ground fuel storage device that minimizes the risk of tampering, fire, and explosion.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

SUMMARY OF THE INVENTION

To achieve the foregoing objects, and in accordance with the purposes of the invention as embodied and broadly described herein, there is provided an above-ground storage device for volatile liquids, the device comprising a tank for storing volatile liquid, a base for disposal on the ground beneath the tank, an enclosure including walls mounted on and above the base for encasing the tank, the enclosure defining air space between the tank and the walls, air space ventilation means for ventilating the air space, a tank vent including at least one duct extending from the tank through one of the walls for ventilating the tank, and fire retaining means for retaining a tank fire within the enclosure.

BRIEF DESCRIPTION OF THE DRAWINGS

The present invention will be described by referring to the accompanying drawings wherein.

DESCRIPTION OF THE PREFERRED EMBODIMENTS

Figure 1:
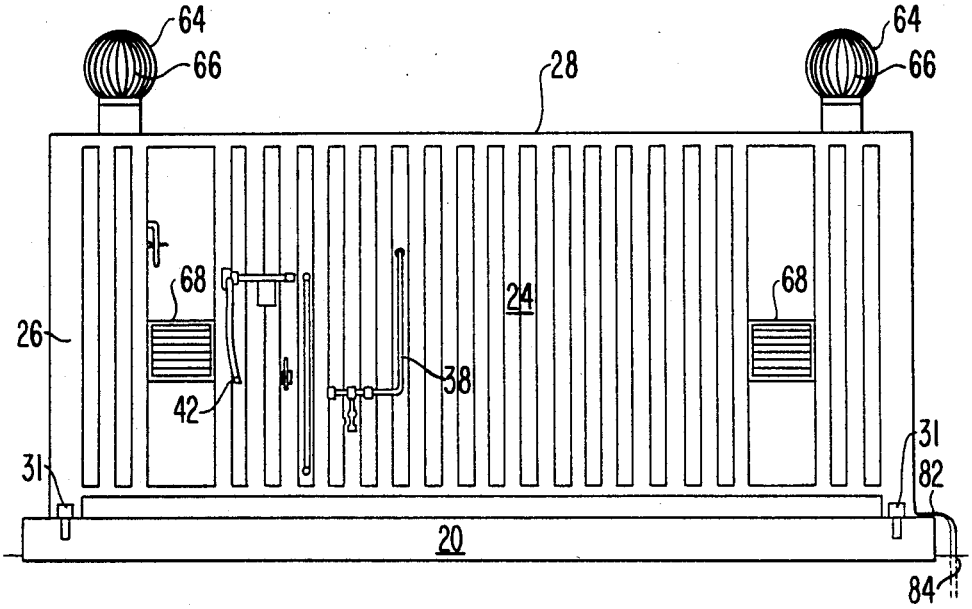
FIG. 1 is a side elevation of a fuel container module in accordance with the present invention.
Figure 2:
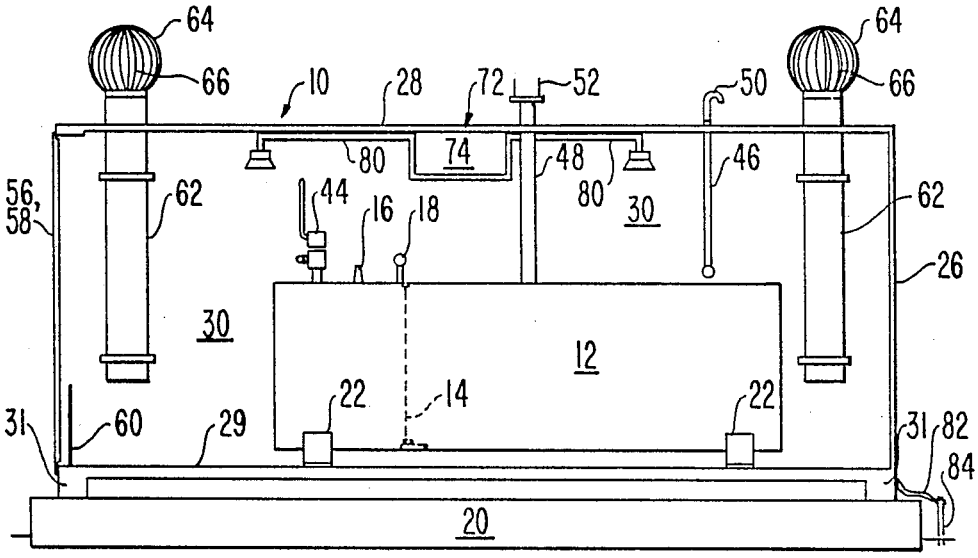
FIG. 2 is an elongated cross-sectional view of FIG. 1.
Figure 3:
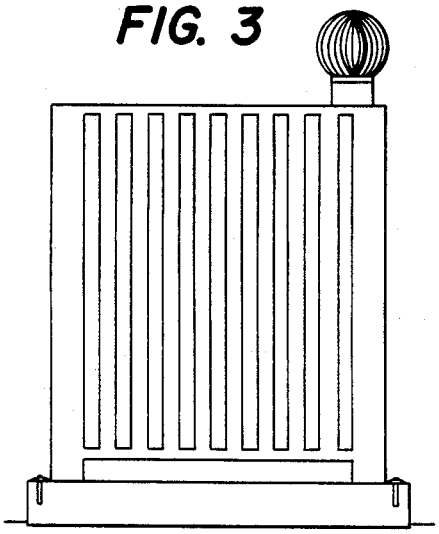
FIG. 3 is an end view of the fuel container module shown in FIG. 1.
Figure 4:
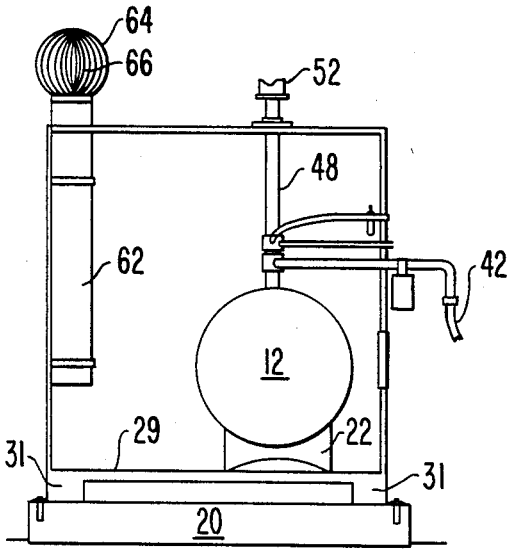
FIG. 4 is a cross-sectional end view of the fuel container module shown in FIG. 1.
Figure 5:
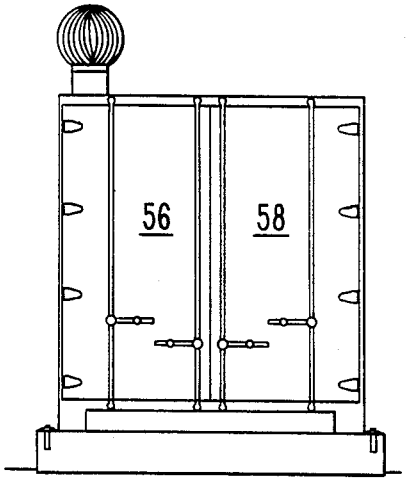
FIG. 5 is a door end view of the fuel container module of FIG. 1.

In accordance with the present invention, there is provided an above-ground storage device comprising a tank for storing volatile liquid. As shown in FIG. 2, storage device 10 includes tank 12. Tank 12 may be made of any type of suitable material for holding volatile liquids such as petroleum products and solvents. Filler ground 14 is attached to the inside of tank 12 and extends through the interior of the tank to electrically ground the tank contents. Tank 12 also includes a conventional overfill protection device 16 and conventional fuel sight gauge 18.

In accordance with the present invention, there is also provided base means for disposal beneath said tank. As embodied herein, base means means may include floor 29. Base means may also include slab 20 disposed beneath floor and tank supports 22 disposed beneath tank 12 to prevent a round tank from rolling.

In accordance with the present invention, there is provided enclosure means including walls disposed on and above said base means for encasing said tank, said enclosure means defining air space between said tank and said walls. As embodied herein, enclosure means includes corrugated steel outer shell 24 having four side walls 26, top wall 28, and floor 29. Floor 29 is disposed above concrete slab 20 on legs 31. Side walls 26 are mounted on floor 29 and spaced a predetermined distance from tank 12 about the periphery of floor 29. Top wall 28 is mounted a predetermined distance above the top of tank 12 on side walls 26. The spacing between tank 12, side walls 26, and top wall 28 define an air space 30 around tank 12.

Figure 6:
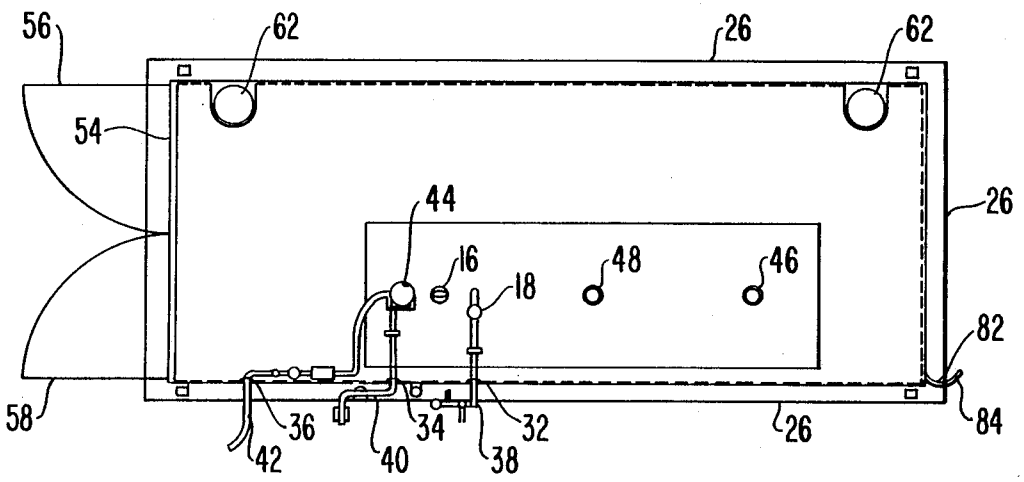
FIG. 6 is a cross-sectional top view of FIG. 1.

In a preferred embodiment and as shown in FIG. 6, openings 32, 34, and 36 are provided in a wall 26 for tank filler line 38, fuel delivery line 40, and compressed air line 42, respectively. Tank filler line 38 is provided between the exterior of outer shell 24 and tank 12 for filling the tank. Fuel delivery line 40 includes a pneumatic pump 44 and is provided to remove liquid from tank 12. Compressed air line 42 extends through outer shell 24 to provide power to pneumatic pump 44. While an electric pump may be used in place of pneumatic pump 44, a pneumatic pump reduces the risk of electrical fire and is, therefore, preferred.

It is also preferred that enclosure 24 include door opening 54 fitted with hinged steel doors 56, 58. Containment plate 60 is welded across door opening 54 with edges against floor 29 and side walls 26 to retain a tank leak within outer shell 24 even when doors 56, 58 are opened. Containment plate 60 is sized to retain the entire volume of tank 12 within outer shell 24.

It is further preferred that ground strap 82 be connected between outer shell 24 as an electrical ground. Ground strap 82 may be made of any suitable type of electrical conductor and may be secured to the ground by ground post 84.

In accordance with the invention, there is provided air space ventilation means for ventilating the air space. As embodied herein, air space ventilation means may include one or more air ducts 62 extending through top wall 28 of outer shell 24. Each air duct 62 includes a conventional ventilator turbine 64 disposed on the end of the duct exterior to outer shell 24. Wind, turning rotors 66 of turbines 64, draws air from air space 30 out of the outer shell 24. Air louvers 68 are provided in side walls 26 of outer shell 24 to allow fresh air to replace air evacuated by turbines 64.

Figure 7:
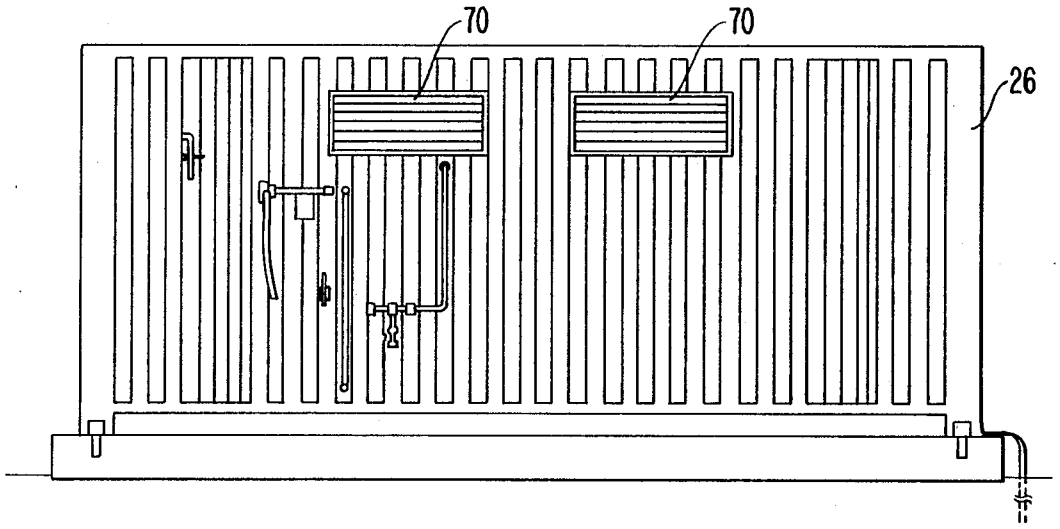
FIG. 7 is a side elevation of a second embodiment of a fuel containment module in accordance with the present invention.

In a second embodiment, as depicted in FIG. 7, air space ventilation means includes a number of louvers 70 disposed in the side walls 26 of outer shell 24. Louvers 70 allow air to freely flow into and out of outer shell 24, thereby providing ventilation.

Also in accordance with the invention, there is provided tank vent means including at least one duct extending from the tank through one of the walls for ventilating the tank. In a preferred embodiment, at least one duct includes two ducts 46, 48 extending from tank 12 through top wall 28. Normal tank vent duct 46 includes inverted U-shaped end piece 50 disposed exterior to outer shell 24 and is sized to permit ventilation of the tank under normal conditions. Emergency relief duct 48 is sized larger than normal relief duct 46 to vent the tank in emergency situations such as a build-up of a dangerous amount of pressure. Emergency relief duct 48 is fitted with an emergency relief vent cap 52 designed to open after a preselected pressure is reached.

In accordance with the invention, there is also provided fire retaining means for retaining a tank fire within the enclosure. As embodied herein, fire retaining means may include the outer shell 24 formed of a fire resistant material such as corrugated steel. In addition, walls 26, 28 may be covered with a fire retaining insulation. Fire retaining means may also include a fire extinguishing system 72 disposed within outer shell 24. Fire extinguishing system 72 may include an extinguisher tank 74 connected to nozzels 70 through pipes 80. A fire retaining chemical, stored within extinguisher tank 74 may be automatically sprayed within outer shell 24 if the temperature exceeds a prescribed level.

Additional advantages and modifications of the present invention may occur to those skilled in the art. The invention in its broader aspects is, therefore, not limited to the specific details, representative apparatus and illustrative examples shown and described. Accordingly, departures may be made from such details without departing from the spirit or scope of the general inventive concept as defined by the appended claims and their equivalents.

What is claimed is:

1. An above-ground storage device for volatile liquid, the device comprising:

a tank for storing volatile liquid;

base means for disposal beneath said tank;

enclosure means including walls disposed on and above said base means for encasing said tank, said enclosure means defining air space between said tank and said walls and including a door opening and door means disposed in said door opening for providing access to said tank;

air space ventilation means for ventilating said air space;

tank vent means including at least one duct extending from said tank through one of said walls for ventilating said tank; and fire retaining means for retaining a tank fire within said enclosure.

2. A device as set forth in claim 1, wherein said base means includes a concrete slab.

3. A device as set forth in claim 1, wherein said fire retaining means includes said walls of said enclosure means, said walls being made of corrugated steel.

4. A device as set forth in claim 1, wherein said fire retaining means includes fire retaining insulation disposed on said walls of said enclosure means.

5. A device as set forth in claim 1, wherein said fire retaining means includes an automatic fire extinguishing system disposed within said enclosure.

6. A device as set forth in claim 1, wherein said door means includes hinged steel doors.

7. A device as set forth in claim 1, further including a containing plate disposed across said door opening for containing said liquid in the event of a tank leak.

8. A device as set forth in claim 1, wherein said air space ventilation means includes air louvers disposed in the walls of said enclosure means.

9. A device as set forth in claim 1, wherein said air space ventilation means includes at least one duct extending through one of said walls, said duct having a first end disposed inside said enclosure means and a second end disposed outside said enclosure means, said duct including a turbine disposed on its second end.

10. A device as set forth in claim 1, further including an emergency relief duct extending from said tank means through one of said walls.

11. A device as set forth in claim 1, further including a filling duct extending from said tank through one of said walls to allow said tank to be filled.

12. A device as set forth in claim 1, further including grounding means for electrically grounding said enclosure means and said tank.

13. A device as set forth in claim 1, further including a fuel delivery duct extending from said tank through said walls for removing liquid from said tank.

14. An above-ground storage device for volatile liquids, the device comprising:

a concrete base;

a tank disposed above said base;

a tank enclosure having walls surrounding and enclosing the tank and defining an air space between said walls and said tank, the enclosure including a door opening;

at least one door mounted in said door opening;

a liquid containment plate disposed across said door opening for retaining liquid within said enclosure in the event of a tank leak;

at least one relief duct extending from said tank through a wall of said enclosure to vent said tank;

at least one ventilation duct extending from said air space through said enclosure, said duct including a turbine for drawing air from said air space to outside said enclosure;

at least one duct extending from said tank through a wall of said enclosure for conveying liquid between said tank and an area exterior to said enclosure; and at least one electrical connector electrically connecting said tank and said enclosure to an electrical ground.

15. A device as set forth in claim 14, wherein the interior side of said enclosure walls are covered with a fire retaining insulation.

16. A device as set forth in claim 14, wherein said at least one ventilation duct includes two ducts, each duct including a turbine.

17. An above-ground storage device for volatile liquids, the device comprising:

a concrete base;

a tank disposed above said base;

a tank enclosure disposed on said base having walls surrounding and enclosing the tank and defining an air space between said walls and said tank, the enclosure including a door opening;

at least one door mounted in said door opening;

a liquid containment plate disposed across said door opening and having an edge engaging said base for retaining liquid in the event of a tank leak;

at least one relief duct extending from said tank through a wall of said enclosure to vent said tank;

at least one air louver disposed on a wall of said enclosure for ventilating said air space;

at least one duct extending from said tank through a wall of said enclosure for filling and emptying said tank; and at least one electrical connector electrically connecting said tank and said enclosure to an electrical ground.

18. A device as set forth in claim 17, wherein the interior side of said enclosure walls are covered with a fire retaining insulation.

* * * * *